United States Patent [19]

Johnson et al.

[11] 3,932,101

[45] Jan. 13, 1976

[54] CORNER FINISHING TOOL

[75] Inventors: Eugene R. Johnson, Burlingame; Morris F. Mower, Santa Clara, both of Calif.

[73] Assignee: Bliss & Laughlin Industries, Inc., Oak Brook, Ill.

[22] Filed: Sept. 9, 1974

[21] Appl. No.: 504,253

[52] U.S. Cl. ..... 425/458; 15/235.7; 425/87

[51] Int. Cl.[2] ..... B28B 7/08; B05C 17/10

[58] Field of Search ..... 425/87, 458; 15/235.3, 15/235.4, 235.5, 235.6, 235.7, 235.8, 236 R; 401/9; 52/749

[56] References Cited

UNITED STATES PATENTS

| | | | |
|---|---|---|---|
| 2,178,899 | 11/1939 | Shaffer | 15/235.7 |
| 2,594,606 | 4/1952 | Ames | 425/87 |
| 2,595,742 | 5/1952 | Wood | 15/235.7 |
| 2,608,853 | 9/1952 | Schrepper | 15/235.7 |
| 2,787,056 | 4/1957 | Dobratz | 15/236 R X |
| 3,237,235 | 3/1966 | Moody | 15/235.3 |

*Primary Examiner*—Francis S. Husar
*Assistant Examiner*—John S. Brown

[57] ABSTRACT

A corner finishing tool for applying mastic material along a wall joint comprising an angular retainer plate having a pair of integral sides resiliently joined at a corner, a pair of L-shaped rigid frame members secured thereto, one side and frame member being resiliently movable relative to the other side and frame member while together defining a cavity reservoir for mastic material, and a wheel having substantially conical side surfaces that converge to a center rim. The corner finishing tool also provides means for setting the L-shaped rigid frame members to a preset position under an adjustable resilient biasing force.

9 Claims, 7 Drawing Figures

CORNER FINISHING TOOL

This application relates to corner finishing tools for applying mastic material along a wall joint. Tools of this general kind are presently known, and the invention described herein is believed to be an improvement thereon.

One principal object of the present invention is to provide a corner finishing tool having superior action and ease of movement along a wall joint.

Another object of the invention is to provide a corner finishing tool having features that enhance its manufacture and increase the accuracy of applying mastic material under a range of conditions.

Other objects and advantages of this invention will become apparent in view of the following detailed description.

In the drawings forming a part of this application and in which like parts are identified by like reference numerals throughout the same:

Figure 1:
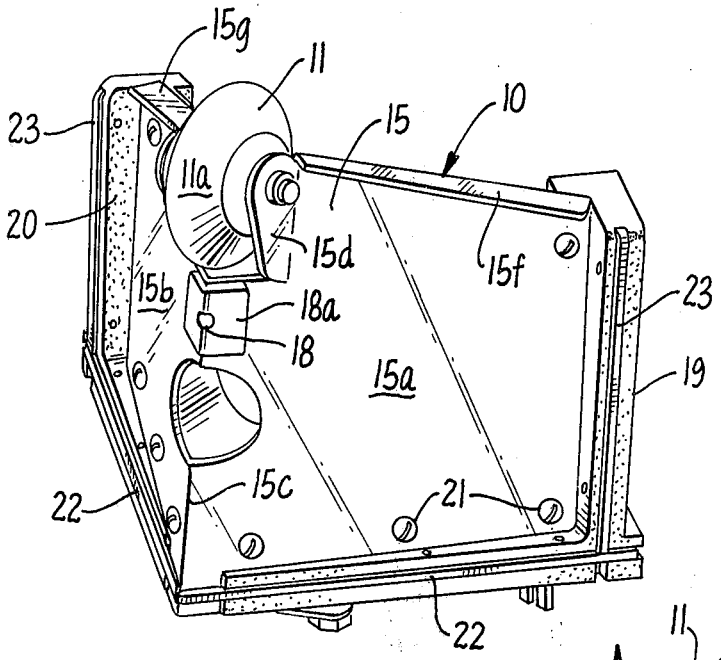
FIG. 1 is a perspective view of a preferred embodiment of the invention in a corner finishing tool.
Figure 2:
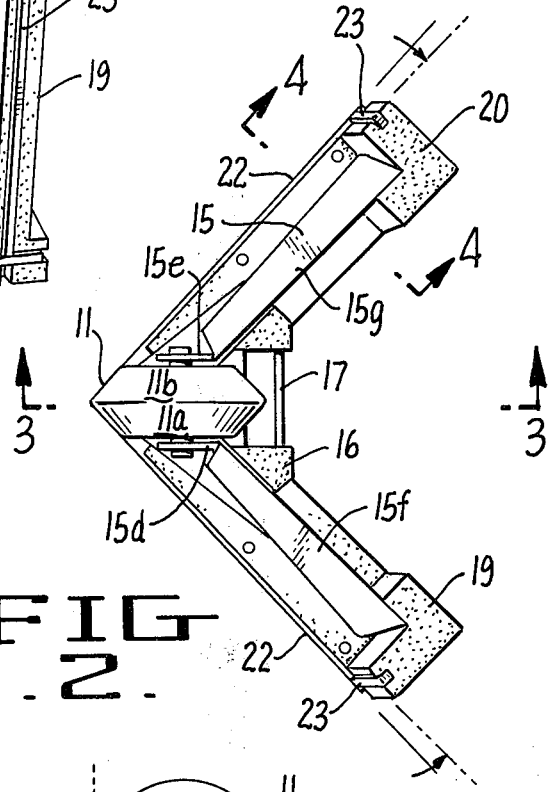
FIG. 2 is a top plan view of the finishing tool.
Figure 5:
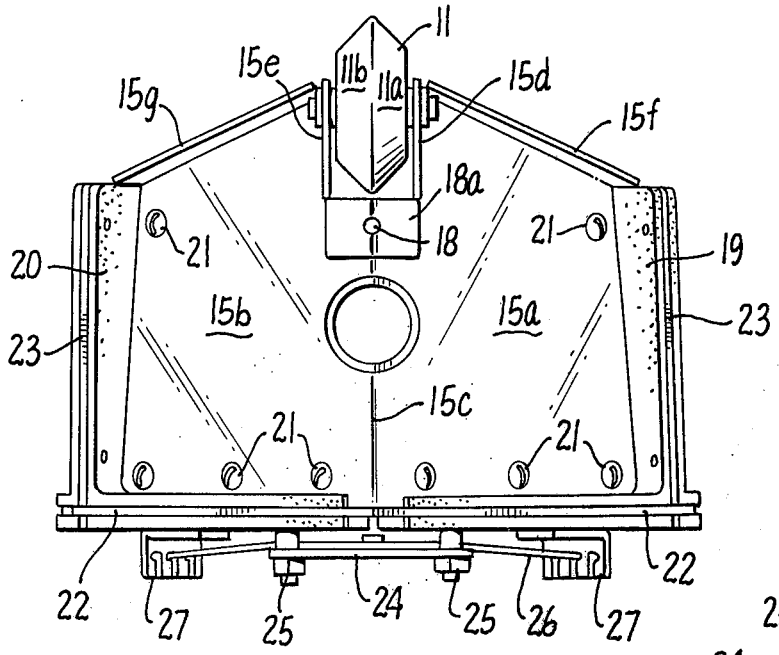
FIG. 5 is a front elevation of the tool.
Figure 6:
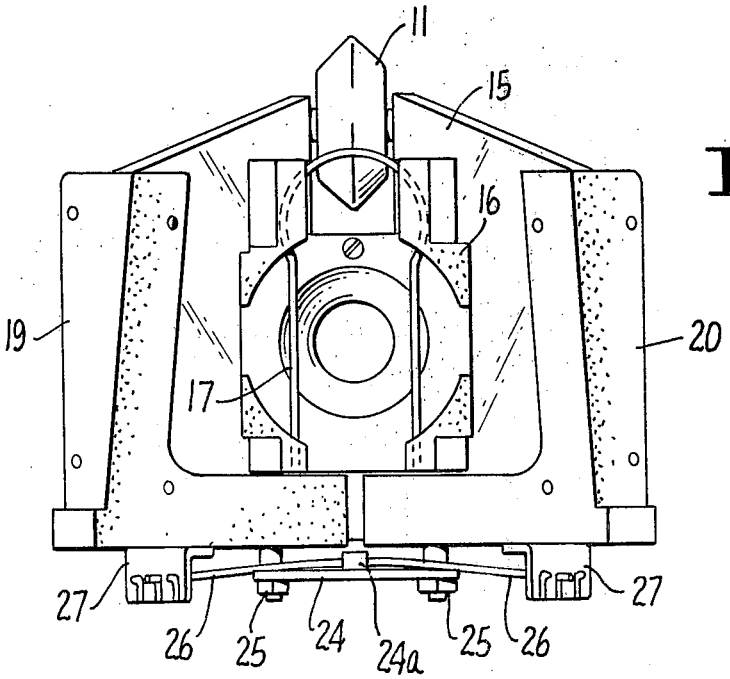
FIG. 6 is a rear elevation of the tool.

Referring to FIG. 1 in particular, finishing tool 10 essentially comprises a container means for mastic material defining a cavity that is open in two convergent and substantially perpendicular planes and having surfaces that converge peripherally of the cavity for doctoring mastic material that flows thereunder. In that regard, tool 10 is not unlike the prior art. Notwithstanding, however, and unlike other corner finishing tools known to applicants, tool 10 embodies novel features of construction including a wheel 11 formed with substantially conical side surfaces 11*a* and 11*b* that converge to a center rim. The included angle between two generating elements of the conical side surfaces is approximately 90°, as best shown in FIGS. 2, 5 and 6; and this shape is important in locating the tool cavity and maintaining the cavity in precise relationship to a wall joint. In addition, the wheel facilitates movement of the tool along a wall joint.

Tool 10 possesses other structural features which enhance its operation. More particularly, the tool comprises an angular retainer plate 15 made of resilient material, such as spring steel, and having a pair of integral sides 15*a* and 15*b* resiliently joined at a corner 15*c*. A pair of ears 15*d* and 15*e*, also integrally formed on plate 15, serve as a support for wheel 11. Plate 15 further includes a pair of upper flanges 15*f* and 15*g* which partially define the cavity for retaining mastic.

A socket bracket 16 is mounted to plate 15 for connecting tool 10 to a mastic dispenser having a ball terminal, the construction of which are well known in this art. Details of the socket bracket 16 are also generally known, including the spring retainer clip 17 that holds tool 10 on the ball terminal of the dispenser. Socket 16 is secured to retainer plate 15 by means of a screw 18 and angle nut 18*a*.

A pair of L-shaped rigid frame members 19 and 20 are mounted to the lower and side edges of retainer plate 15 with machine screws 21. The lower and side legs of each frame member is slotted to receive a pair of doctor blades 22 and 23. The pair of doctor blades 22 come together near the corner 15*c*, while doctor blades 23 extend upward from the ends of blades 22, thereby framing the cavity.

Figure 4:
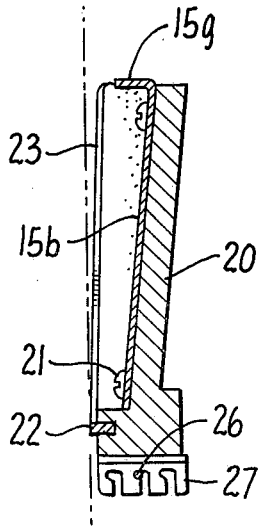
FIG. 4 is a vertical section taken on the lines 4—4 of FIG. 2.
Figure 3:
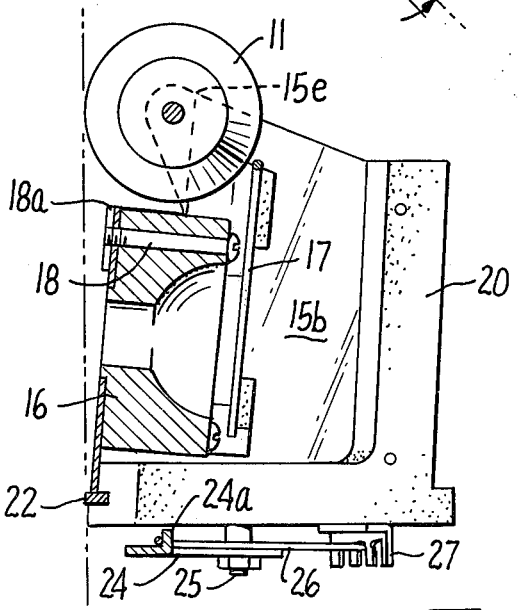
FIG. 3 is a vertical section taken on the lines 3—3 of FIG. 2.

It is to be noted that doctor blades 22 and 23 are mounted in the slots of L-shaped frame members 19 and 20 with great precision. In that regard, it is customary to mount blades 23 to produce a "feathering" action during the application of mastic material. More particularly, and referring to FIG. 4, blades 23 are set in vertical slots of members 19 and 20 with the upper ends slightly spaced from planes that are defined by doctor blades 22 and the contact surfaces 11*a* and 11*b* of wheel 11. The lower ends of blades 23, however, are in surface alignment with doctor blades 22. This structural relationship is important in obtaining an even application of mastic material along a wall joint.

Tool 10 further provides means for setting the L-shaped frame members 19 and 20 to a preset angular position under an adjustable resilient biasing force. For this purpose a link member 24, formed with slotted openings at both ends, interconnects a pair of posts 25 mounted to frame members 19 and 20; and, in the preferred construction, plate 15 is given an angularity in an unstressed condition that, when assembled to the frame members and with link 24 in place, the plate will be under a resilient stress, the slotted ends of the link contacting post 25 and holding the frame members in their preset position. The preferred preset position places doctor blades 22 at an angle of approximately 95°. Of course, this position changes when the tool is held under pressure in a corner of 90°. At such time, plate 15 will flex at its corner 15c, thereby accommodating the precise angularity of the wall joint.

Figure 7:
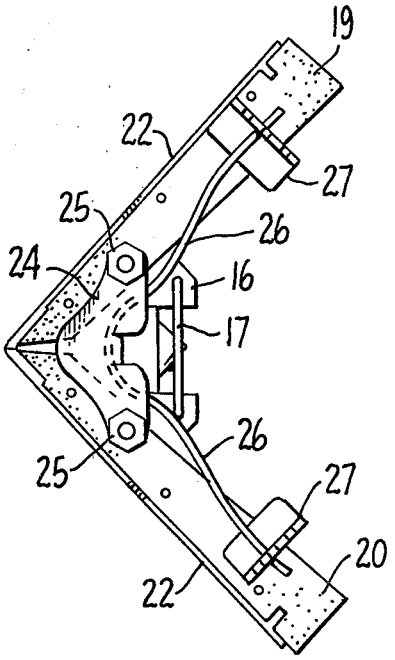
FIG. 7 is a bottom plan view of the tool.

Although the resiliency of plate 15 may be sufficient in its manufacture, repeated use of the tool may reduce that resiliency or its responsiveness. Accordingly, additional means may be provided to return the frame members 19 and 20 to the preset position. For this purpose, an auxiliary spring 26 is provided, as best shown in FIG. 7. Spring 26 engages a lip 24*a* formed on the link, and opposite ends of the spring are secured in slotted brackets 27, one bracket being mounted on each frame member 19 and 20. The tension of spring 26 is adjusted by selectively locating the ends of the spring in one of three slots formed in each bracket 27.

Although a preferred embodiment of this invention has been illustrated and described, various modifications and changes may be resorted to without departing from the spirit of the invention or the scope of the appended claims, and each of such modifications and changes is contemplated.

What is claimed is:

1. A corner finishing tool for applying mastic material along a wall joint comprising container means defining a cavity that is open in two convergent and substantially perpendicular planes and having surfaces in each of said planes that converge peripherally of said cavity for doctoring mastic material that flows thereunder; and a wheel having substantially conical side surfaces that converge to a center rim, said wheel being rotatably mounted from said container means to contact the walls of a wall joint with the conical side surfaces and position the cavity relative thereto.

2. The corner finishing tool of claim 1, the included angle between two generating elements of the conical side surfaces being approximately 90°.

3. The corner finishing tool of claim 1, said container means comprising an angular retainer plate having a pair of integral sides resiliently joined at a corner; a pair of L-shaped rigid frame members secured to said pair of integral sides, respectively, one side and frame member being resiliently movable relative to the other side and frame member while together defining a cavity reservoir for mastic material.

4. The corner finishing tool of claim 3, and further comprising a pair of convergent doctor blades, one doctor blade being mounted in each frame member, said pair of convergent doctor blades coming together proximate the corner of said retainer plate.

5. The corner finishing tool of claim 3, and further comprising link means connecting said frame members, said link means allowing said angular retainer plate to be resiliently flexed at the corner in a direction that lessens the included angle between the integral sides but limits movement in an opposite direction to a preset angle.

6. The corner finishing tool of claim 5 and further comprising means for adjusting the resilient force biasing said pair of integral sides and retainer members to the preset angle determined by said link means.

7. The corner finishing tool of claim 3, said retaining plate having a pair of integrally formed parallel ears for mounting said wheel, said ears extending from the pair of integral sides, respectively.

8. A corner finishing tool for applying mastic material along a wall joint comprising: container means defining a cavity that is open in two convergent and substantially perpendicular planes and having surfaces in each of said planes that converge peripherally of said cavity for doctoring mastic material that flows thereunder, said container means comprising an angular retainer plate having a pair of integral sides resiliently joined at a corner; a pair of L-shaped rigid frame members secured to said pair of integral sides, respectively, one side and frame member being resiliently movable relative to the other side and frame member while together defining a cavity reservoir for mastic material; and a pair of convergent doctor blades supported in one leg of each frame member and coming together proximate the corner of said retainer plate.

9. The corner finishing tool of claim 8 and further comprising a pair of brackets mounted to said frame member respectively, each bracket having slots; a spring member selectively engageable with the slots of said brackets to allow an adjustment in spring tension; and link means connecting said frame members, said link means allowing said angular retainer plate to be resiliently flexed at the corner in a direction that lessens the included angle between the integral sides but limits movement in the opposite direction to a preset angle.

* * * * *